United States Patent [19]

Sambucetti et al.

[11] 4,149,470

[45] Apr. 17, 1979

[54] HOPPER GATE

[75] Inventors: Eugene D. Sambucetti; Keith L. Mathews, both of Woodland, Calif.

[73] Assignee: Wesco Truck & Trailer Sales, Woodland, Calif.

[21] Appl. No.: 823,087

[22] Filed: Aug. 9, 1977

[51] Int. Cl.[2] ..... B65G 65/66

[52] U.S. Cl. ..... 105/282 P

[58] Field of Search ..... 222/505, 509, 559; 251/215, 250, 194, 203, 193; 105/282, 282 P

[56] References Cited

U.S. PATENT DOCUMENTS

| | | | |
|---|---|---|---|
| 2,386,702 | 10/1945 | McBride | 105/282 P |
| 3,298,323 | 1/1967 | Becker et al. | 105/282 P |

*Primary Examiner*—Stanley H. Tollberg

[57] ABSTRACT

A water tight hopper gate has a support and control system enabling limited vertical movement of the gate whereby unwanted liquid may be drained from a solids load and enabling subsequent horizontal movement of the gate for the discharge of the solids load.

5 Claims, 5 Drawing Figures

HOPPER GATE

SUMMARY OF THE INVENTION

Hopper trailers of both the semi and full types are used to haul various commodities. Tomatoes, for examples, are hauled from a collection site to a processing location. When delivered to the processing location it is required that tomato solids not including tomato juice be delivered. Normally, under the wear and tear conditions of loading and hauling, there will be some tomato juice along with the solids. With the hopper gate of the present invention the unwanted juice may be drained out of the load at one station before the desired load of total solids is delivered to a second station.

The essential object of the invention is to provide a water tight hopper gate which may be bodily dropped a short distance to drain liquid from solids and thereafter moved horizontally to an open position for the discharge of solids.

Other objects and advantages of the invention will be apparent from the following description taken in conjunction with the drawing forming part of this specification, and in which.

Figure 1:
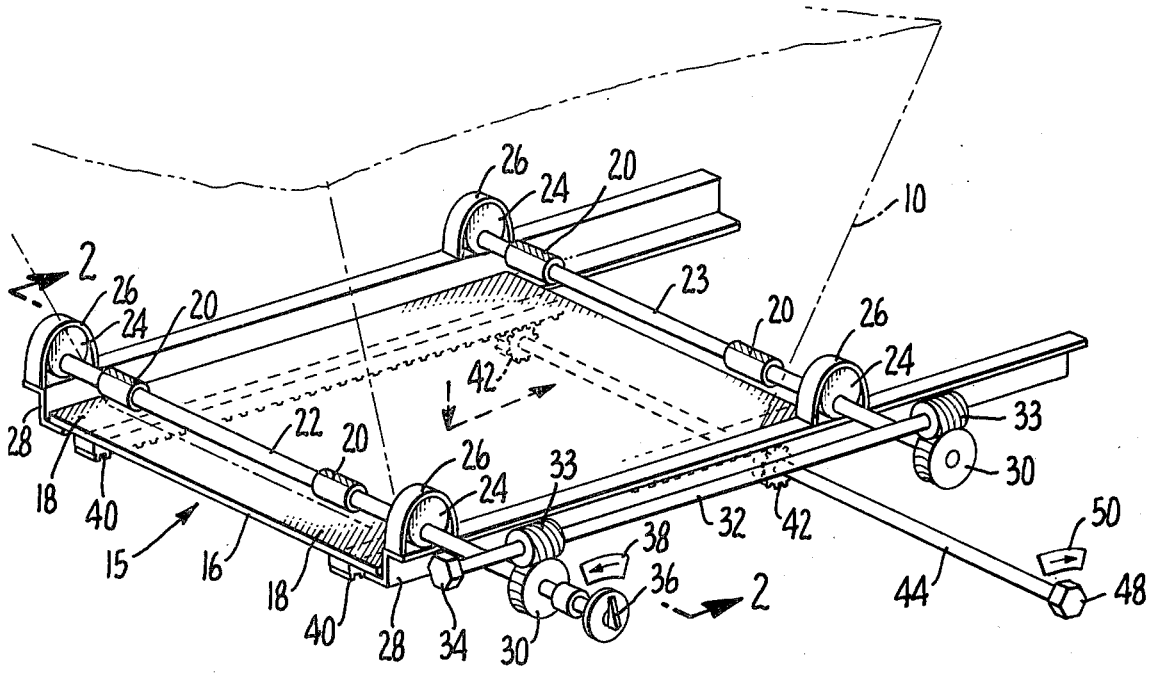
FIG. 1 is a view in perspective of the improved hopper gate of the invention.
Figure 2:
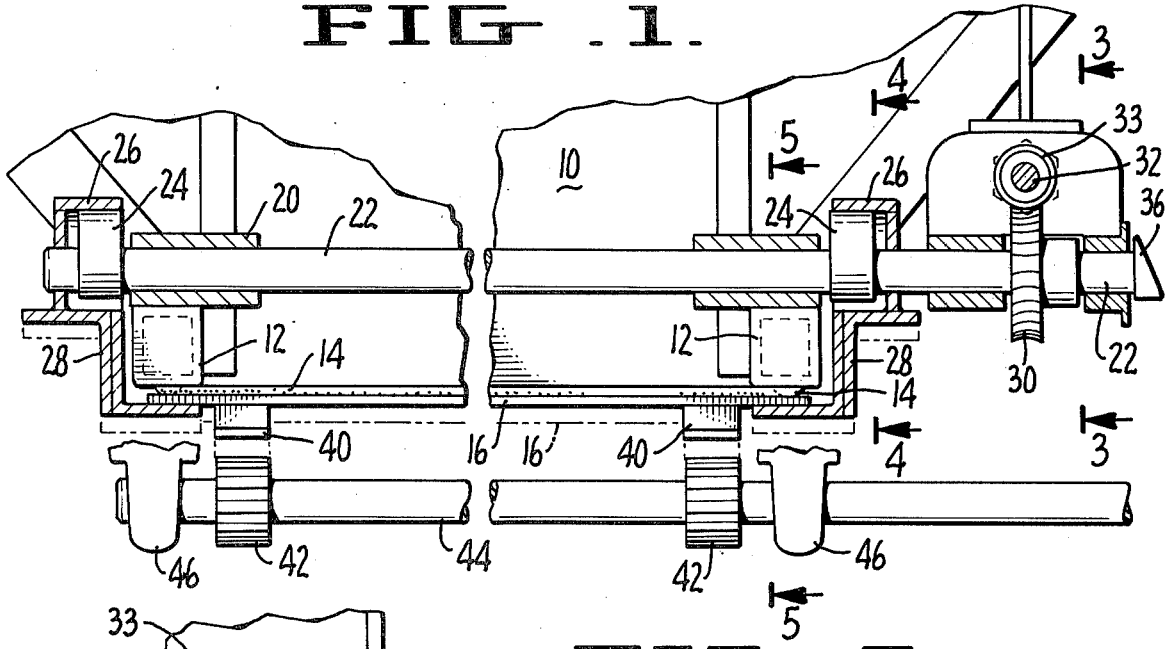
FIG. 2 is an enlarged view taken along lines 2—2 of FIG. 1.
Figure 3:
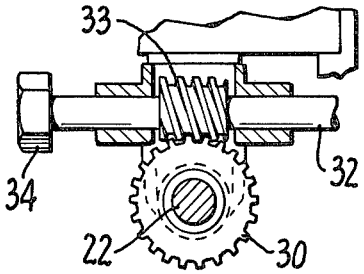
FIG. 3 is a detail view taken along lines 3—3 of FIG. 2.
Figure 4:
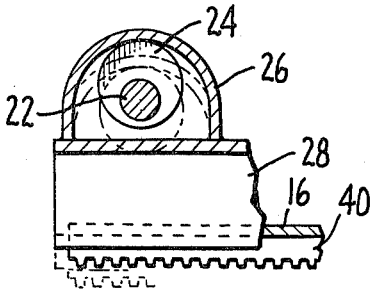
FIG 4 is a detail view taken along lines 4—4 of FIG. 2.
Figure 5:
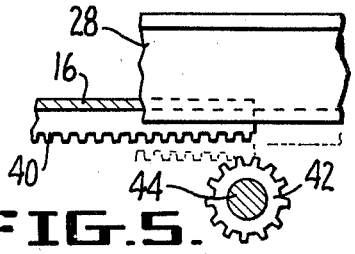
FIG. 5 is a detail view taken along lines 5—5 of FIG. 2.

With reference to the drawing, the hopper 10 is mounted on a wheeled chassis in a normal and usual manner. The discharge opening at the bottom of the hopper 10 is defined by four box channel members 12 which have welded to the undersides half-round strips 14 bias-cut and joined at their ends so as to provide a continuous quadrilateral sealing edge defined by the center lines of the round sides of the four half-round strips.

The hopper is provided with a hopper gate indicated generally at 15 comprising a steel plate 16 which is provided about the periphery of its upper side with rubber gasket strips 18 adapted to engage the half-round metal bars 14 and form a water tight seal. Plate 16 is carried by hopper 10 for limited up and down movement, e.g. about five-eighths of an inch, relative thereto by means comprising four sleeve elements 20 fixedly attached to hopper 10, two camshafts 22 and 23 rotatably carried by the sleeve elements 20, cams 24 fixed to the shafts 22 and 23, cam yokes 26 supported by the cams 24, and a pair of generally Z-shaped channel members 28 to which the yokes 26 are fixedly attached. The plate 16 is slidably supported by members 28.

The shafts 22 and 23 are provided with manually operable drive means comprising spiral gear elements 30 affixed to the shafts 22 and 23, cross-shaft 32, worm gear elements affixed to shaft 32, and a wrench-engageable driving head 34 on shaft 32. Shaft 22 is provided with a pointer 36. A direction indicia tab 38 is provided in association with pointer 36, the direction arrow on tab 38 indicating the direction in which the pointer is to rotate in order to effect a lowering of the plate 16 so that the hopper gate is in the lowered or liquid-draining position.

When the gate is in the raised position, the hopper opening is sealed by the compression of the rubber gasket strips 18 by the half-round bars 14, and the gate is held in this position by the natural interlocking action between the spiral and worm gear elements 30, 33.

The means for horizontally moving the gate comprise racks 40 secured to the bottom of plate 16 and pinions 42 carried by a shaft 44 which is journalled in supports 46 attached to the hopper-chassis framework. Shaft 44 is provided with a wrench-engageable driving head 48. A direction indicia tab 50 is provided in association with driving head 48, the direction arrow on tab 50 indicating the direction in which the shaft 44 is to be rotated in order to horizontally open the gate for the discharge of solids from the hopper.

When the gate is in the raised, sealing position, the racks 40 are disposed out of engagement with the pinions 42. Horizontal movement of the gate while the bars 14 are in sealing engagement with the gasket strips 18 is therefore not possible. When the gate is in the lowered, non-sealing position, the racks 40 are engaged with the pinions 42, allowing the gate to be opened to the maximum open position by clockwise rotation (FIG. 1) of shaft 44.

The gate is operated as follows, considering that it is in the raised, sealing position to start with. Shaft 32 is rotated clockwise (FIG. 1) to rotate shafts 22 and 23 counterclockwise and turn the cams 24 180°, thus moving the gate downwardly for liquid-draining of the hopper load and engaging the racks 40 with the pinions 42. Shaft 44 may then be rotated clockwise (FIG. 1) to horizontally open the gate. After discharge of the hopper load the gate is moved laterally to center it beneath the hopper opening. Shaft 32 is then cranked counterclockwise (FIG. 1) to effect clockwise rotation of shafts 22 and 23 and cams 24 and consequent lifting of the gate to disengage racks 40 from pinions 42 and close and seal the hopper opening.

Instead of being mounted on the hopper-chassis framework so that it does not move up and down with the gate, the pinion-carrying shaft 44 may be mounted on the members 28 so that it moves up and down therewith, i.e. the pinions 42 are disposed in full time engagement with the racks 40.

What is claimed is:

1. In combination, a hopper having a material discharge opening at its lower end defined by a peripheral sealing surface, a gate for said opening comprising a plate having a peripheral sealing surface, means to selectively raise said plate to engage said sealing surfaces and thereby seal said opening and to lower said plate to disengage said sealing surfaces and thereby unseal said opening, said raising and lowering means comprising support means for said gate interconnecting said hopper and said gate, said support means comprising a plurality of horizontally disposed shafts carried for rotation by said hopper, and a plurality of eccentrics attached to each shaft for rotation therewith and connected through cam followers to said plate, and means for moving said plate horizontally to open and close said opening.

2. The combination of claim 1, said last-mentioned means comprising rack means carried at the underside of said plate, pinion means engageable with said rack means, and shaft means to selectively rotate said pinion means.

3. The combination of claim 2, including a crankable control shaft for said horizontally disposed shafts connected thereto by worm and spiral gear elements.

4. The combination of claim 3, one of said sealing surfaces having a rubber gasket facing and the other of said sealing surfaces having a sealing lip formed of half-round metal bars adapted to be pressed against said facing.

5. The combination of claim 2, said rack means being moved into engagement with said pinion means by the lowering of said plate to unseal said opening and being moved out of engagement with said pinion means by the raising of said plate to seal said opening.

* * * * *